US009839951B2

(12) United States Patent
Nishimura et al.

(10) Patent No.: US 9,839,951 B2
(45) Date of Patent: Dec. 12, 2017

(54) MANUFACTURING METHOD AND MANUFACTURING APPARATUS OF PRESS-FORMED BODY

(71) Applicant: NIPPON STEEL & SUMITOMO METAL CORPORATION, Tokyo (JP)

(72) Inventors: Ryuichi Nishimura, Tokyo (JP); Kenichiro Otsuka, Tokyo (JP); Yoshiaki Nakazawa, Tokyo (JP); Yoshihiko Masuo, Tokyo (JP); Toshiya Suzuki, Tokyo (JP); Yoshiyuki Ikeda, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 14/408,175

(22) PCT Filed: Jun. 20, 2013

(86) PCT No.: PCT/JP2013/066985
§ 371 (c)(1),
(2) Date: Dec. 15, 2014

(87) PCT Pub. No.: WO2013/191256
PCT Pub. Date: Dec. 27, 2013

(65) Prior Publication Data

US 2015/0174634 A1 Jun. 25, 2015

(30) Foreign Application Priority Data

Jun. 22, 2012 (JP) ..... 2012-141127

(51) Int. Cl.
*B21D 17/02* (2006.01)
*B21D 22/26* (2006.01)
(Continued)

(52) U.S. Cl.
CPC ..... *B21D 17/02* (2013.01); *B21D 5/01* (2013.01); *B21D 22/26* (2013.01); *B21D 53/88* (2013.01); *B21J 5/12* (2013.01); *B21J 13/02* (2013.01)

(58) Field of Classification Search
CPC .. B21D 17/02; B21D 53/88; B21J 5/12; B21J 13/02
(Continued)

(56) References Cited

U.S. PATENT DOCUMENTS 2,176,738 A 10/1939 Clark
4,398,984 A * 8/1983 Uchiyama et al. ..... 156/196
(Continued)

FOREIGN PATENT DOCUMENTS

EA 012124 B1 8/2009
JP 5-23761 A 2/1993
(Continued)

OTHER PUBLICATIONS

English translation of the International Preliminary Report on Patentability and English translation of the Written Opinion of the International Searching Authority (Forms PCT/IB/338, PCT/IB/373 and PCT/ISA/237), dated Dec. 31, 2014, for International Application No. PCT/JP2013/066985.
(Continued)

*Primary Examiner* — Teresa M Ekiert
*Assistant Examiner* — Gregory Swiatocha
(74) *Attorney, Agent, or Firm* — Birch, Stewart, Kolasch & Birch, LLP

(57) ABSTRACT

A press-formed body (15) made of a high-tensile strength steel sheet of 390 MPa or more including a groove bottom part (15*a*), ridge line parts (15*b*, 15*b*) continuous to the groove bottom part (15*a*), and side wall parts (15*c*, 15*c*) continuous to the ridge line parts (15*b*, 15*b*), and in which
(Continued)

an outward flange (16) is formed at an end part in a longitudinal direction is manufactured by a press-forming apparatus including a punch (11), a die (12), and a pad (14) which presses and binds a press-forming material (13) to the punch (11), thereby forming the press-formed body (15) without providing cutouts at a ridge line part flange portion of the outward flange, or generating lowering of material yield.

14 Claims, 13 Drawing Sheets

(51) Int. Cl.

| | |
|---|---|
| ***B21D 53/88*** | (2006.01) |
| ***B21D 5/01*** | (2006.01) |
| ***B21J 5/12*** | (2006.01) |
| ***B21J 13/02*** | (2006.01) |

(58) Field of Classification Search
USPC ..... 72/343, 348, 349, 350, 351
See application file for complete search history.

(56) References Cited

U.S. PATENT DOCUMENTS

| | | | | |
|---|---|---|---|---|
| 5,067,336 | A * | 11/1991 | de Smet | 72/57 |
| 5,701,777 | A * | 12/1997 | Yamanaka et al. | 72/350 |
| 6,503,639 | B1 * | 1/2003 | Iwaya | B21D 25/02 428/167 |
| 7,310,878 | B2 * | 12/2007 | Chernoff | B62D 25/20 29/421.1 |
| 7,862,108 | B2 * | 1/2011 | Tamakoshi | 296/203.03 |
| 7,971,466 | B2 * | 7/2011 | Yoshitome | B21D 22/02 72/355.2 |
| 2008/0184764 | A1 * | 8/2008 | Nakamura et al. | 72/350 |
| 2010/0018280 | A1 * | 1/2010 | Maeda et al. | 72/358 |
| 2012/0297853 | A1 * | 11/2012 | Tanaka et al. | 72/350 |
| 2012/0324974 | A1 * | 12/2012 | Nakamura et al. | 72/305 |
| 2013/0239645 | A1 | 9/2013 | Tanaka et al. | |

FOREIGN PATENT DOCUMENTS

| | | | |
|---|---|---|---|
| JP | 8-1243 | A | 1/1996 |
| JP | 08001243 | A * | 1/1996 |
| JP | 3194407 | B2 | 7/2001 |
| JP | 2002-263744 | A | 9/2002 |
| JP | 2009-255116 | A | 11/2009 |
| JP | 4438468 | B2 | 3/2010 |
| JP | 2010-115674 | A | 5/2010 |
| JP | 2012-51005 | A | 3/2012 |
| SU | 1181746 | A | 9/1985 |
| WO | WO 2012/070623 | A1 | 5/2012 |

OTHER PUBLICATIONS

International Search Report, dated Sep. 24, 2013, issued in PCT/JP2013/066985.

Written Opinion of the International Searching Authority, dated Sep. 24, 2013, issued in PCT/JP2013/066985.

Canadian Office Action for Canadian Application No. 2,875,789, dated Jul. 21, 2016.

Extended European Search Report dated Feb. 18, 2016, issued in corresponding European Patent Application No. 13807701.1.

Russian Office Action and Search Report for Russian Application No. 2015101812/02, dated May 3, 2016, with an English translation of the Office Action only.

* cited by examiner

MANUFACTURING METHOD AND MANUFACTURING APPARATUS OF PRESS-FORMED BODY

TECHNICAL FIELD

The present invention relates to a manufacturing method and a manufacturing apparatus of a press-formed body, and specifically, to a manufacturing method and a manufacturing apparatus of a press-formed body made of a high-tensile strength steel sheet with a tensile strength of 390 MPa or more having approximately a groove-shaped cross section including a groove bottom part, ridge line parts continuous to the groove bottom part, and side wall parts continuous to the ridge line parts, and in which an outward flange is formed at an end part in a longitudinal direction.

BACKGROUND ART

A floor of a vehicle body (hereinafter, referred to just as a "floor") is not only primary responsible for torsional rigidity and bending rigidity of a vehicle body at a vehicle traveling time, but also responsible for transfer of an impact load during crash, further it largely affects on a weight of the vehicle body, and therefore, it is required to include antinomy characteristics of both high rigidity and light weight. The floor includes planar panels (for example, a dash panel, a front floor panel, a rear floor panel, and so on) which are welded to be joined with each other, long members (for example, a floor cross member, a seat cross member, and so on) having approximately groove-shaped cross sections which are fixed to be disposed in a vehicle width direction of these planar panels by welding to enhance rigidity and strength of the floor, and long members (a side sill, a side member, and so on) having approximately groove-shaped cross sections which are fixed to be disposed in a vehicle forward and backward direction to enhance the rigidity and the strength of the floor. For example, the floor cross member is normally joined to other members such as, for example, a tunnel part of the front floor panel and the side sill via outward flanges formed at both end parts in a longitudinal direction.

FIG. 12A, FIG. 12B are explanatory views illustrating a floor cross member 1. FIG. 12A is a perspective view, and FIG. 12B is a XII arrow view in FIG. 12A.

In general, the floor cross member 1 is joined to an upper surface (a surface at an interior side) of a front floor panel 2. A floor is reinforced by this floor cross member 1 coupling a tunnel part (not-illustrated) formed by bulging at approximately a center in a width direction of the front floor panel 2 and side sills 3 spot-welded at both side parts in a width direction of the front floor panel 2. The floor cross member 1 has approximately a groove-shaped cross section, and it is spot-welded to the tunnel part and the side sills 3 via outward flanges 4 formed at both end parts in a longitudinal direction thereof, and thereby, rigidity of the floor and a load transfer characteristic when an impact load is applied improve.

FIG. 13A and FIG. 13B are explanatory views schematically illustrating a conventional press-forming method of the floor cross member 1. FIG. 13A is the explanatory view schematically illustrating drawing in which forming is performed while applying a binding force at an end of a material by a blank holder. FIG. 13B is the explanatory view schematically illustrating bend-forming using a developed blank 6.

In the press-forming by the drawing illustrated in FIG. 13A, an excess part 5*a* is formed at a press-forming material 5, the excess part 5*a* is cut along a cutting-line 5*b*, and thereafter, a flange 5*c* is stood up. Besides, in the press-forming by the bend-forming illustrated in FIG. 13B, the press-forming by the bend-forming is performed for the developed blank 6 having a developed blank shape. The floor cross member 1 is conventionally formed by performing the press-forming by the drawing illustrated in FIG. 13A or the press-forming by the bend-forming illustrated in FIG. 13B. From a point of view of improving material yield, the press-forming by the bend-forming is preferable than the press-forming by the drawing accompanied by the cutting of the excess part 5*a*.

The floor cross member 1 is an important structural member which is responsible for the rigidity improvement of the vehicle body and absorption of the impact load during side crash (side impact). Accordingly, in recent years, a thinner and higher strength high-tensile strength steel sheet, for example, a high-tensile strength steel sheet with a tensile strength of 390 MPa or more (a high-strength steel sheet or a HSS [high tensile strength steel]) has been used as a material of the floor cross member 1 from a point of view of reduction in weight and improvement in crash safety. However, formability of the high-tensile strength steel sheet is not good, and therefore, it is a problem that flexibility of design of the floor cross member 1 is low.

It is concretely described with reference to FIG. 12A and FIG. 12B. It is desirable to form the continuous outward flange 4 at a whole periphery of an end part of the floor cross member 1, and to obtain a flange width with a certain degree of length to enhance joining strength and torsional rigidity between the floor cross member 1 and the tunnel part of the front floor panel 2, the side sills 3, and to enhance the rigidity of the floor and the load transfer characteristic during crash.

However, it is difficult to obtain a desired shape when the continuous outward flange 4 is formed at the whole periphery of the end part of the floor cross member 1, and to obtain the flange width with the certain degree of length because basically, stretch flange cracks at a flange part corresponding to an outer periphery of a ridge line part of the outward flange 4 (hereinafter, referred to as a "ridge line part flange portion") and wrinkling at a proximity part 1*b* of the outward flange 4 at a ridge line part 1*a* occur. These forming failures are easy to occur as a material strength of the floor cross member 1 is higher, and as a stretch flange rate at the forming of a ridge line part flange portion 4*a* of the outward flange 4 is higher (namely, for example, as a cross sectional wall angle θ in FIG. 12B is steeper, or as a flange height is higher).

The floor cross member 1 tends to be high-strengthened to reduce the weight of the vehicle body, and tends to be designed to a shape with high stretch flange rate from a point of view of performance thereof and a joint part shape with other members, and therefore, the forming of the continuous outward flange 4 including the ridge line part flange portion 4*a* is difficult to be enabled by the conventional press-forming method. Accordingly, it is the present situation in which cutouts cannot but be provided at the ridge line part flange portion 4*a* of the outward flange 4 of the floor cross member 1 made up of the high-tensile strength steel sheet as illustrated in FIG. 12A and FIG. 12B from restrictions on the press-forming technology as stated above even if lowering of the performance of the floor cross member 1 is accepted.

In Patent Literatures 1 to 3, the inventions are disclosed, in which a shape fixability failure in a high-strength material press-forming product is solved by devising a pad mechanism of a metal forming-tool though it is not intended for the forming of the floor cross member 1. These inventions are ones in which deflection is intentionally generated at a material during the forming by a positional relationship of the pad pressing at least a portion of a part (groove bottom part) where a punch top part and a punch top part face with each other, to thereby enable improvement in the shape fixability after the forming.

CITATION LIST

Patent Literature

Patent Literature 1: Japanese Patent Publication No. 4438468

Patent Literature 2: Japanese Laid-open Patent Publication No. 2009-255116

Patent Literature 3: Japanese Laid-open Patent Publication No. 2012-051005

SUMMARY OF INVENTION

Technical Problem

It is difficult to form the floor cross member 1 being a press-formed body made of a high-tensile strength steel sheet of 390 MPa or more having approximately a groove-shaped cross section including a groove bottom part, ridge line parts, and side wall parts, and in which an outward flange is formed at a range across at least a portion of each of the ridge line part, the groove bottom part and the side wall part at both sides of the ridge line part from among an end part in a longitudinal direction without providing cutouts at the ridge line part flange portion 4*a* of the outward flange 4 or without generating lowering of material yield, even if the conventional inventions disclosed in Patent Literatures 1 to 3 are based on.

An object of the present invention is to provide a method and an apparatus manufacturing a press-formed body such as, for example, a floor cross member made of a high-tensile strength steel sheet of 390 MPa or more having approximately a groove-shaped cross section including a groove bottom part, ridge line parts, and side wall parts, and in which an outward flange is formed at a range across at least a portion of each of the ridge line part, the groove bottom part and the side wall part at both sides thereof, from among an end part in a longitudinal direction without providing cutouts at a ridge line part flange portion of the outward flange or without generating lowering of material yield.

Solution to Problem

The present invention is as cited below.

[1] A manufacturing method of a press-formed body made of a high-tensile strength steel sheet of 390 MPa or more having approximately a groove-shaped cross section including a groove bottom part, ridge line parts continuous to the groove bottom part, and side wall parts continuous to the ridge line parts, and in which an outward flange is formed at a range across at least a portion of each of the ridge line part, the groove bottom part and the side wall part at both sides thereof, from among an end part in a longitudinal direction by performing a press-forming of a press-forming material by a press-forming apparatus which includes a punch, a die, and a pad pressing and binding the press-forming material to the punch, the manufacturing method includes: a first step of performing the press-forming while the pad binds a part to be formed into the groove bottom part and at least a portion of a part to be formed into the ridge line part at the press-forming material; and a second step of performing the press-forming of parts which are not able to be formed by the first step.

[2] The manufacturing method of the press-formed body according to [1], wherein the pad binds a part having a length of one-third or more of a cross-sectional peripheral length of the ridge line part starting from a connecting part with the groove bottom part.

[3] The manufacturing method of the press-formed body according to [1] or [2], wherein the pad binds the part to be formed into the ridge line part within a predetermined range from a root part of the outward flange in a direction where the ridge line part extends in a longitudinal direction of the part to be formed into the ridge line part.

[4] The manufacturing method of the press-formed body according to any one of [1] to [3], wherein the press-formed body has approximately the groove-shaped cross section further including curved parts continuous to the side wall parts, and flanges continuous to the curved parts.

[5] The manufacturing method of the press-formed body according to any one of [1] to [4], wherein the press-forming is bend-forming.

[6] The manufacturing method of the press-formed body according to any one of [1] to [4], wherein the press-forming is drawing.

[7] A manufacturing apparatus of a press-formed body, manufacturing the press-formed body made of a high-tensile strength steel sheet of 390 MPa or more having approximately a groove-shaped cross section including a groove bottom part, ridge line parts continuous to the groove bottom part, and side wall parts continuous to the ridge line parts, and in which an outward flange is formed at a range across at least a portion of each of the ridge line part, the groove bottom part and the side wall part at both sides thereof, from among an end part in a longitudinal direction, the manufacturing apparatus includes: a punch; a die; and a pad which presses and binds a press-forming material to the punch, wherein the pad has a shape binding a part to be formed into the groove bottom part and at least a portion of a part to be formed into the ridge line part at the press-forming material.

[8] The manufacturing apparatus of the press-formed body according to [7], wherein the pad has a shape binding a part having a length of one-third or more of a cross-sectional peripheral length of the ridge line part starting from a connecting part with the groove bottom part.

[9] The manufacturing apparatus of the press-formed body according to [7] or [8], wherein the pad binds the part to be formed into the ridge line part within a predetermined range from a root part of the outward flange in a direction where the ridge line part extends in a longitudinal direction of the part to be formed into the ridge line part.

[10] The manufacturing apparatus of the press-formed body according to any one of [7] to [9], wherein the press-formed body has approximately the groove-shaped cross section further including curved parts continuous to the side wall parts, and flanges continuous to the curved parts.

[11] The manufacturing apparatus of the press-formed body according to any one of [7] to [10], wherein the press-forming is bend-forming.

[12] The manufacturing apparatus of the press-formed body according to any one of [7] to [10], wherein the press-forming is drawing.

Note that the pad according to the inventions disclosed in the Patent Literatures 1 to 3 is one to devise a positional relationship between a punch top part and the pad pressing at least a portion of a part (groove bottom part) facing the punch top part, and the pad according to the present invention is different from the inventions disclosed in the Patent Literatures 1 to 3 in a point in which the pad has a shape which intentionally presses also the ridge line part.

Advantageous Effects of Invention

According to the present invention, it is possible to surely form a press-formed body made of a high-tensile strength steel sheet of 390 MPa or more having approximately a groove-shaped cross section including a groove bottom part, ridge line parts, and side wall parts, and in which an outward flange is formed at a range across the ridge line part, at least a portion of each of the groove bottom part and the side wall part at both sides thereof, from among an end part in a longitudinal direction without providing cutouts at a ridge line part flange portion of the outward flange or without generating lowering of material yield.

DESCRIPTION OF EMBODIMENTS

Hereinafter, embodiments of the present invention are described with reference to the attached drawings.

Figure 1A:
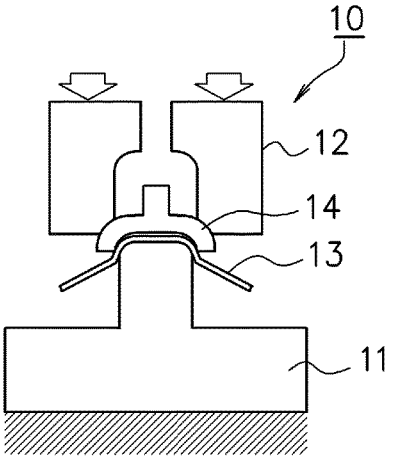
FIG. 1A is a view schematically illustrating a schematic configuration of a manufacturing apparatus of a press-formed body according to an embodiment and a first step.
Figure 1B:
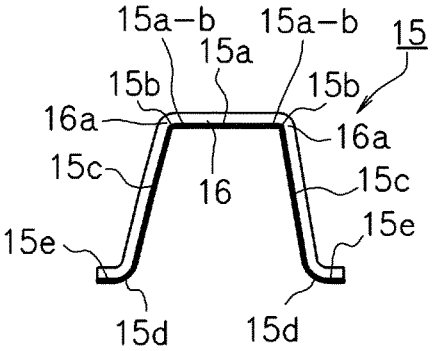
FIG. 1B is a sectional view illustrating a transverse cross-sectional shape of a press-formed body manufactured in the present embodiment.
Figure 1C:
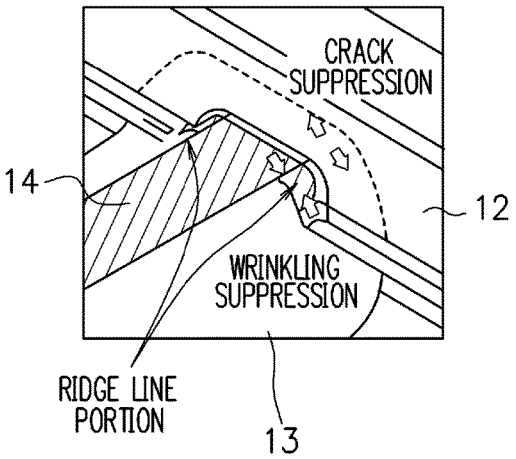
FIG. 1C is a perspective view illustrating a configuration at around a ridge line pad in the first step.
Figure 1D:
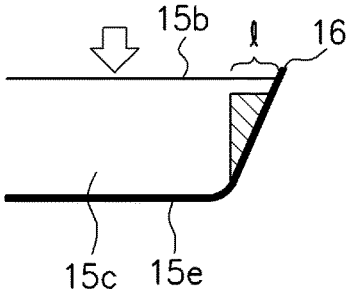
FIG. 1D is a view when the press-formed body manufactured in the present embodiment is seen from a lateral side in a longitudinal direction.

FIG. 1A to FIG. 1D are explanatory views conceptually illustrating characteristics of a manufacturing method and a manufacturing apparatus of a press-formed body according to an embodiment where the present invention is applied. FIG. 1A is a view schematically illustrating a schematic configuration of the manufacturing apparatus of the press-formed body according to the embodiment and a first step. FIG. 1B is a sectional view illustrating a transverse sectional shape of the press-formed body manufactured in the present embodiment. FIG. 1C is a perspective view illustrating a configuration at around a ridge line pad in the first step. FIG. 1D is a view when the press-formed body manufactured in the present embodiment is seen from a lateral side in a longitudinal direction. Note that in each of FIG. 1B and FIG. 1D, a sheet thickness is represented by a heavy line.

1. Press-Formed Body

As illustrated in FIG. 1B, the press-formed body manufactured in the present embodiment is a press-formed body 15 which is long and made of a high-tensile strength steel sheet of 390 MPa or more, having approximately a groove-shaped cross section including a groove bottom part 15*a*, ridge line parts 15*b*, 15*b* continuous to the groove bottom part 15*a*, side wall parts 15*c*, 15*c* continuous to the ridge line parts 15*b*, 15*b*, curved parts 15*d*, 15*d* continuous to the side wall parts 15*c*, 15*c*, and flanges 15*e*, 15*e* continuous to the curved parts 15*d*, 15*d*. An outward flange 16 is formed at a whole periphery of an end part in a longitudinal direction, namely, along the groove bottom part 15*a*, the ridge line parts 15*b*, 15*b*, the side wall parts 15*c*, 15*c*, the curved parts 15*d*, 15*d*, and the flanges 15*e*, 15*e*.

Figure 12A:
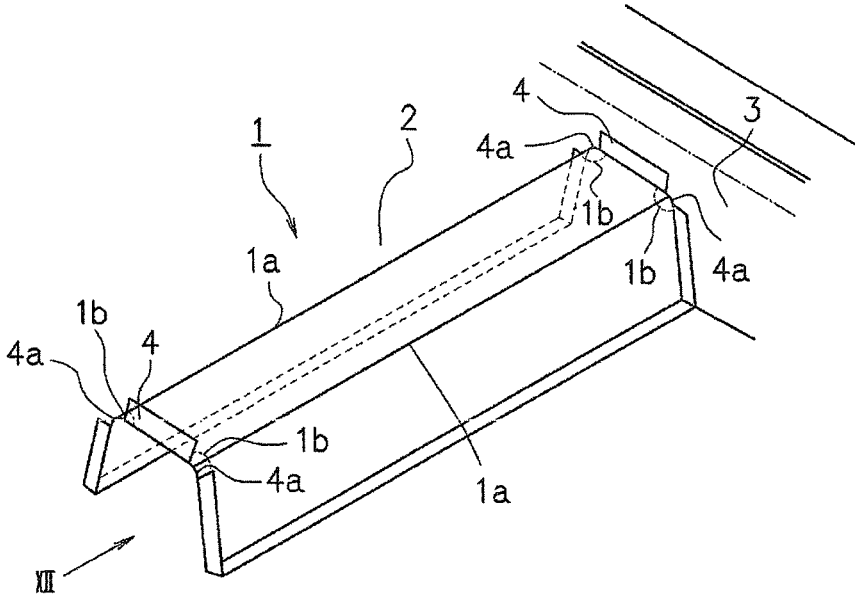
PRIOR ART F I G. 12A
FIG. 12A is a perspective view of a floor cross member.
Figure 12B:
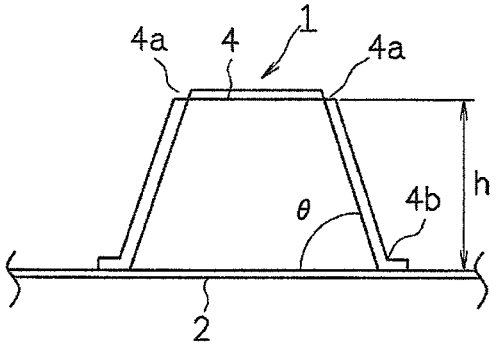
PRIOR ART F I G. 12B
FIG. 12B is an XII arrow view in FIG. 12A.
Figure 13A:
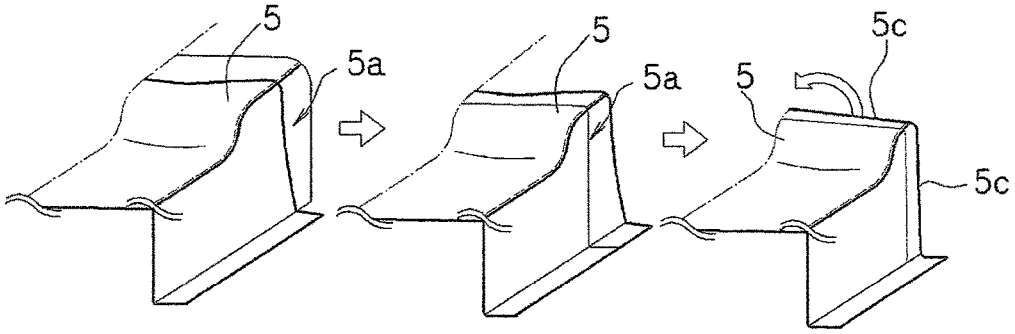
PRIOR ART F I G. 13A
FIG. 13A is an explanatory view schematically illustrating drawing.
Figure 13B:
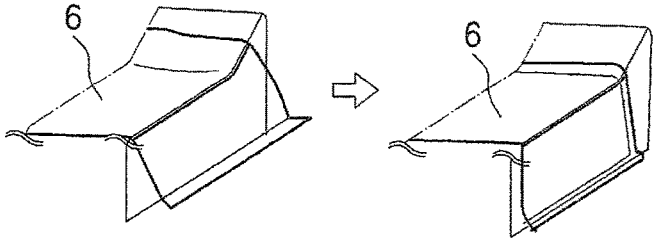
PRIOR ART F I G. 13B
FIG. 13B is an explanatory view schematically illustrating bend-forming.

The press-formed body 15 manufactured in the present embodiment is a press-formed body which does not have cutouts at a ridge line part flange portion 16*a* of the outward flange 16 different from the one illustrated in FIG. 12A, FIG. 12B.

Besides, the press-formed body 15 manufactured in the present embodiment has a cross-sectional height of 20 mm or more. Further, from a point of view of securing a continuous region for welding such as spot welding, laser welding, or plasma welding, a flange width of the outward flange 16 is approximately 5 mm or more at a flange flat part at a part of at least the groove bottom part 15*a*, the ridge line part 15*b*, and the side wall part 15*c*. Besides, at the ridge line part 15*b*, the flange width is approximately 2 mm or more from a point of view of securing performances such as impact characteristics, torsional rigidity even if joining is not performed.

Note that in the present embodiment, a hat-shaped press-formed body having approximately a groove-shaped cross section illustrated in FIG. 1B is described, but the present invention is applicable as long as it is a press-formed body having approximately a groove-shaped cross section including at least the groove bottom part 15*a*, the ridge line parts 15*b*, 15*b*, and the side wall parts 15*c*, 15*c*.

Besides, an example in which the outward flange 16 is formed at the whole periphery at the end part in the longitudinal direction is described, but the present invention is applicable as long as it is a press-formed body in which the outward flange 16 including the ridge line part flange portion 16*a* is formed, in other words, the outward flange 16 is formed at a range across the ridge line part 15*b*, at least a portion of each of the groove bottom part 15*a* and the side wall part 15*c* at both sides thereof.

2. Manufacturing Apparatus of Press-Formed Body (Press-Forming Apparatus)

As illustrated in FIG. 1A, a press-forming apparatus 10 includes a punch 11, a die 12, and a pad 14 which presses and binds a press-forming material 13 to the punch 11. In the present embodiment, the pad 14 is to bind not only a part to be formed into the groove bottom part 15*a* but also parts to be formed into the ridge line parts 15*b*, 15*b* at the press-forming material 13, and it is called as a ridge line pad.

The ridge line pad 14 has a shape binding the part to be formed into the groove bottom part 15*a* and the parts to be formed into the ridge line parts 15*b*, 15*b* in a vicinity of the outward flange 16 at the press-forming material 13.

A publicly-known pad binds the part to be formed into the groove bottom part 15*a*, but does not bind the parts to be formed into the ridge line parts 15*b*, 15*b*. On the other hand, the ridge line pad 14 binds not only the part to be formed into the groove bottom part 15*a* but also the parts to be formed into the ridge line parts 15*b*, 15*b* in the vicinity of the outward flange 16. According to the ridge line pad 14, a shape of the ridge line pad 14 is approximately formed by stretching out only a material at that part. Moving of the material at around a part where the ridge line pad 14 is in contact is thereby suppressed, expansion and shrinkage deformations of a peripheral material to be a factor of cracks and wrinkling are suppressed, and therefore, it is possible to reduce occurrences of stretch flange cracks at the ridge line part flange portion 16*a* of the flange 16 and wrinkling at a proximity part of the flange 16 (refer to a proximity part 1*b* in FIG. 12A) at the ridge line part 15*b*.

The ridge line pad 14 is aimed for an effect suppressing the moving of the peripheral material by stretching out and forming the shape of the ridge line part 15*b* in the vicinity of the outward flange 16. Accordingly, it is desirable to bind a part having a length of one-third or more of a cross-sectional peripheral length of the ridge line parts 15*b*, 15*b* starting from a connecting part 15*a*-*b* from among the part to be formed into the ridge line part 15*b*, more preferably to bind a whole of the cross-sectional peripheral length of the part to be formed into the ridge line part 15*b*. In this case, if it has a shape of a degree in which only a single part of the side wall part 15*c*, for example, a part of the side wall part 15*c* having a length of 20 mm or less in addition to the ridge line part 15*b* are pressed, a problem in which a pad load is insufficient and cannot afford to press is difficult to occur, and therefore, it is acceptable as a pad in the present invention.

Besides, it is preferable that a range bound by the ridge line pad 14 in a longitudinal direction of the part to be formed into the ridge line part 15*b* ("1" illustrated in FIG. 19) is set to be in the vicinity of the outward flange 16, namely, at least a portion of a predetermined range from a root part of the outward flange 16 in a direction where the ridge line part 15*b* extends. The predetermined range is set to be the same degree as a flange width of the ridge line part flange portion 16*a* of the outward flange 16. For example, when the flange width of the ridge line part flange portion 16*a* of the outward flange 16 is 20 mm, the predetermined range is set to be approximately 20 mm, and when the flange width of the ridge line part flange portion 16*a* is 30 mm, the predetermined range is set to be approximately 30 mm. In this case, it is not necessary to bind the part to be formed into the ridge line part 15*b* at a whole area of this predetermined range, and it is no problem if a part of the predetermined range is bound.

Other elements such as a size and a material of the ridge line pad 14 other than the above-stated matters may be the same as a publicly-known pad.

3. Manufacturing Method of Press-Formed Body

In the press-forming apparatus 10, the press-forming is performed while binding the part to be formed into the groove bottom part 15*a* and the parts to be formed into the ridge line parts 15*b*, 15*b* in the vicinity of the outward flange 16 at the press-forming material 13 by using the ridge line pad 14.

To form parts which cannot be formed by this press-forming (a first press-forming step), a second press-forming step being a post-step is performed. The part which cannot be formed by the first press-forming step is concretely a part positioning directly below the ridge line part 15*b* which is bound by the ridge line pad 14 as represented by oblique lines in FIG. 1D. The second press-forming step being the post-step is performed to form the part represented by the oblique lines in FIG. 1D, namely, parts to be formed into a part of the side wall parts 15*c*, 15*c*, parts to be formed into a part of the curved parts 15*d*, 15*d*, and parts to be formed into a part of the flanges 15*e*, 15*e*.

In the second press-forming step, the press-forming may be one using only a die and a punch without using the pad (stamp press-forming), or may be the normal press-bending using the pad.

Note that there is a case when a remaining part of the part to be formed into the ridge line part 15*b* which cannot be formed by the first press-forming step exists depending on the region bound by the ridge line pad 14. In this case, the remaining part of the part which is formed into the ridge line part 15*b* is also press-formed by the second press-forming step. For example, when one-third of the part to be formed into the ridge line part 15*b* is formed by the first press-forming step, the remaining two-thirds of the part to be formed into the ridge line part 15*b* is formed by the second press-forming step.

As stated above, the press-forming material 13 is press-formed (the first press-forming step, the second press-forming step) by the press-forming apparatus including the punch 11, the die 12, and the ridge line pad 14 pressing and binding the press-forming material 13 to the punch 11, and thereby, it is possible to manufacture the press-formed body 15 which is long and made of the high-tensile strength steel sheet of 390 MPa or more having approximately a groove-shaped cross section including the groove bottom part 15*a*, the ridge line parts 15*b*, 15*b* continuous to the groove bottom part 15*a*, the side wall parts 15*c*, 15*c* continuous to the ridge line parts 15*b*, 15*b*, the curved parts 15*d*, 15*d* continuous to the side wall parts 15*c*, 15*c*, and the flanges 15*e*, 15*e* continuous to the curved parts 15*d*, 15*d* in which the outward flange 16 is formed at the whole periphery of the end part in the longitudinal direction illustrated in FIG. 1B.

Note that a concave and convex shape part of 0.1 mm or more is formed at a boundary part between the ridge line part 15*b* and the side wall part 15*c* corresponding to the end part of the ridge line pad 14 at the press-forming time because two times press-formings are performed.

Hereinbelow, a reason why the press-forming is performed by binding not only the part to be formed into the groove bottom part 15*a* but also the parts to be formed into the ridge line parts 15*b*, 15*b* in the vicinity of the outward flange 16 by using the ridge line pad 14 is described with reference to a numerical analysis result by a finite element method.

Analysis Example 1

Figure 2A:
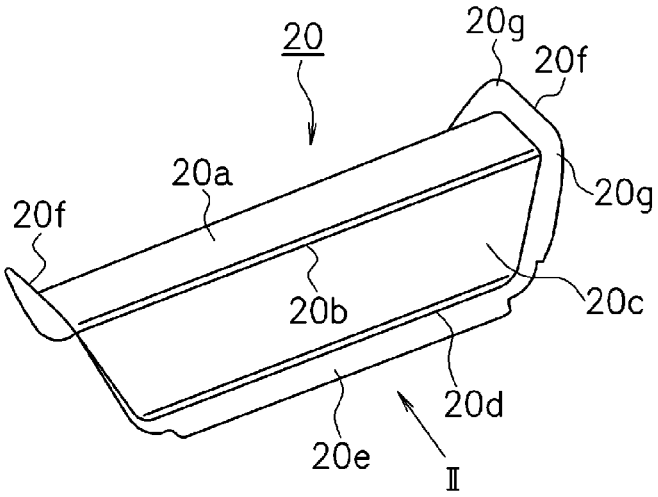
FIG. 2A is a perspective view of a press-formed body of an analysis example 1.
Figure 2B:
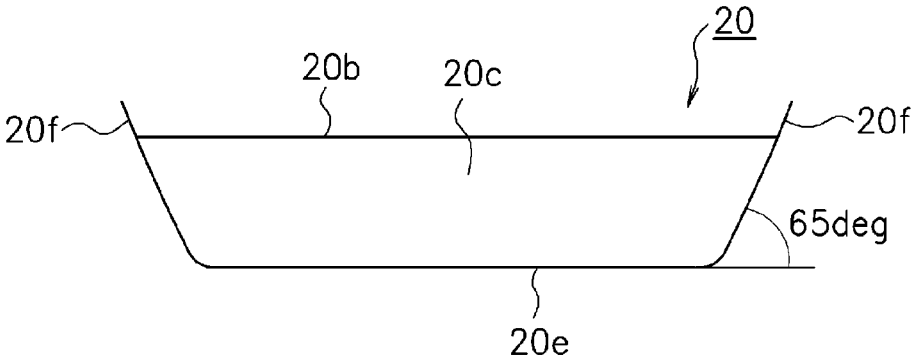
FIG. 2B is a II arrow view in FIG. 2A.
Figure 2C:
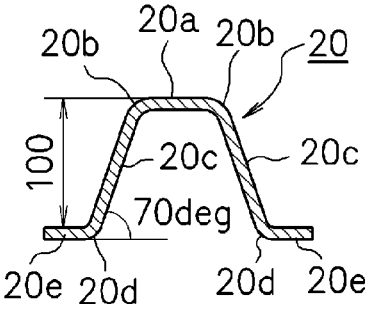
FIG. 2C is a transverse sectional view of the press-formed body of the analysis example 1.

FIG. 2A to FIG. 2C are explanatory views illustrating a shape of a press-formed body 20 of an analysis example 1. FIG. 2A is a perspective view of the press-formed body 20, FIG. 2B is a II arrow view in FIG. 2A, and FIG. 2C is a transverse sectional view of the press-formed body 20 (an outward flange 20*f* is not illustrated).

The press-formed body 20 of the analysis example 1 is made of a high-strength steel sheet (590 MPa class DP (Dual phase) steel), and a sheet thickness thereof is 1.4 mm.

The press-formed body 20 includes a groove bottom part 20*a*, ridge line parts 20*b*, 20*b* continuous to the groove bottom part 20*a*, side wall parts 20*c*, 20*c* continuous to the ridge line parts 20*b*, 20*b*, curved parts 20*d*, 20*d* continuous to the side wall parts 20*c*, 20*c*, and flanges 20*e*, 20*e* continuous to the curved parts 20*d*, 20*d*. A curvature radius at a sheet inner side of the ridge line parts 20*b*, 20*b* is 12 mm.

The outward flanges 20*f* are formed at a whole periphery of both end parts in a longitudinal direction of the press-formed body 20, and a ridge line part flange portion 20*g* becomes a curved portion. A flange width of the outward flange 20*f* is 25 mm at a part formed along the groove bottom part 20*a*, and 30 mm at a part formed along the side wall parts 20*c*, 20*c*.

A cross sectional wall angle of the press-formed body 20 is 70 degrees, and a cross sectional height is 100 mm. In the analysis example 1, the press-formed body 20 is manufactured by the press-forming by bend-forming using a developed blank.

Figure 3A:
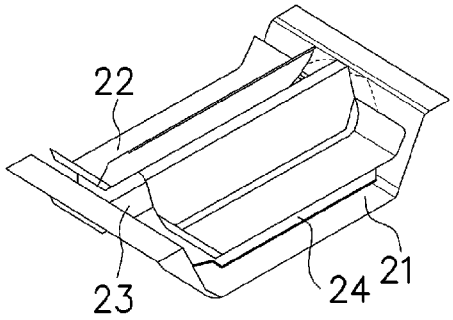
FIG. 3A is a perspective view illustrating a punch, a die, and a press-forming material at a forming time according to the invented method.
Figure 3B:
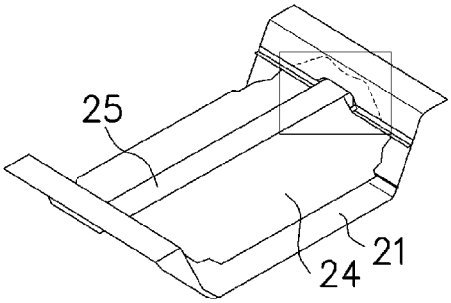
FIG. 3B is a perspective view illustrating the punch, a ridge line pad, and the press-forming material at the forming time according to the invented method.
Figure 3C:
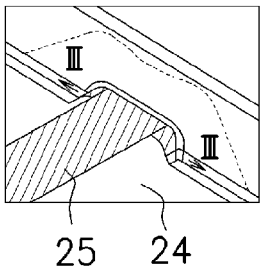
FIG. 3C is a perspective view enlargedly illustrating a square surrounded part in FIG. 3B.
Figure 3D:
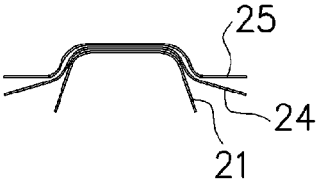
FIG. 3D is a sectional view in FIG. 3C.

FIG. 3A is a perspective view illustrating a punch (lower forming-tool) 21, a die (upper forming-tool) 22, and a press-forming material 24 at a forming time according to the invented method. FIG. 3B is a perspective view illustrating the punch (lower forming-tool) 21, a ridge line pad 25, and the press-forming material 24 at the forming time according to the invented method. FIG. 3C is a perspective view enlargedly illustrating a square surrounded part in FIG. 3B. FIG. 3D is a sectional view in FIG. 3C.

Figure 4A:
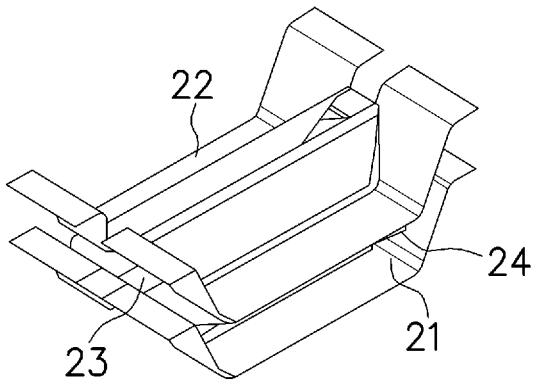
FIG. 4A is a perspective view illustrating a punch, a die, a pad, and a press-forming material at a forming time according to a conventional method.
Figure 4B:
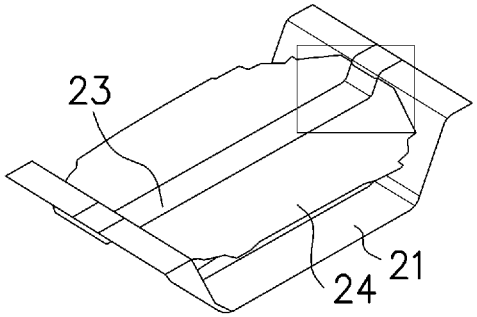
FIG. 4B is a perspective view illustrating the punch, the pad, and the press-forming material at the forming time according to the conventional method.
Figure 4C:
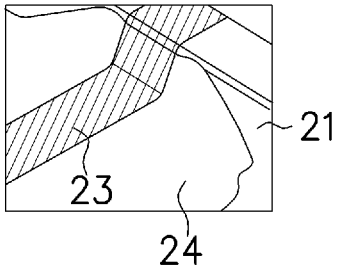
FIG. 4C is a perspective view enlargedly illustrating a square surrounded part in FIG. 4B.

On the other hand, FIG. 4A is a perspective view illustrating a punch (lower forming-tool) 21, a die (upper forming-tool) 22, a pad 23, and a press-forming material 24 at a forming time according to a conventional method. FIG. 4B is a perspective view illustrating the punch (lower forming-tool) 21, the pad 23, and the press-forming material 24 at the forming time according to the conventional method. FIG. 4C is a perspective view enlargedly illustrating a square surrounded part in FIG. 4B.

Figure 5A:
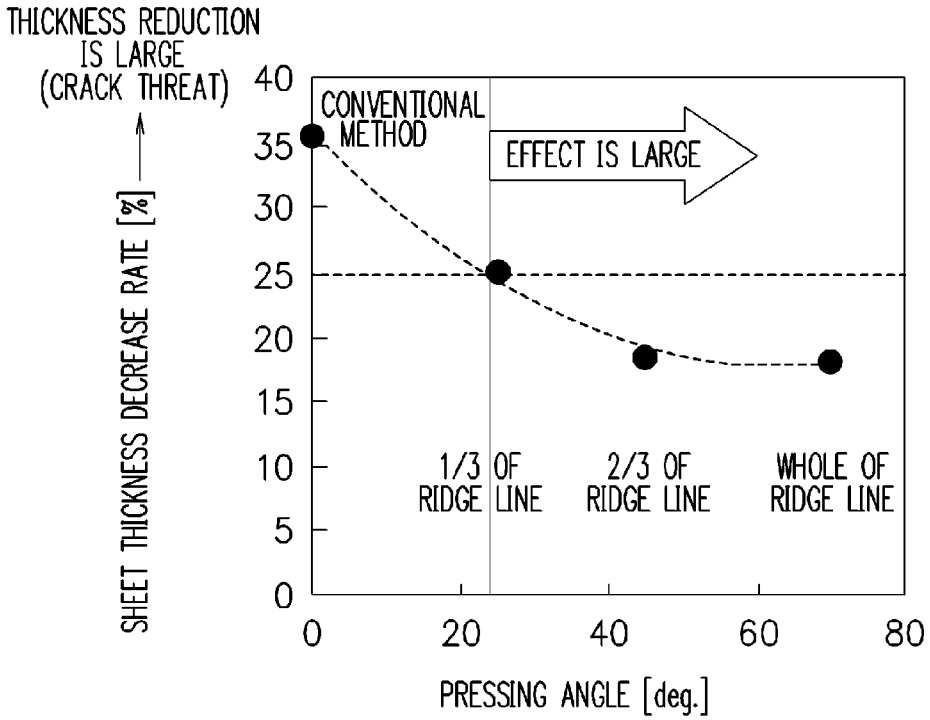
FIG. 5A is a characteristic diagram illustrating a numerical analysis result of a relationship between a pressing angle of the press-forming material by the pad and a maximum value of a sheet thickness decrease at an end part of a ridge line part flange portion of an outward flange in the analysis example 1.
Figure 5B:
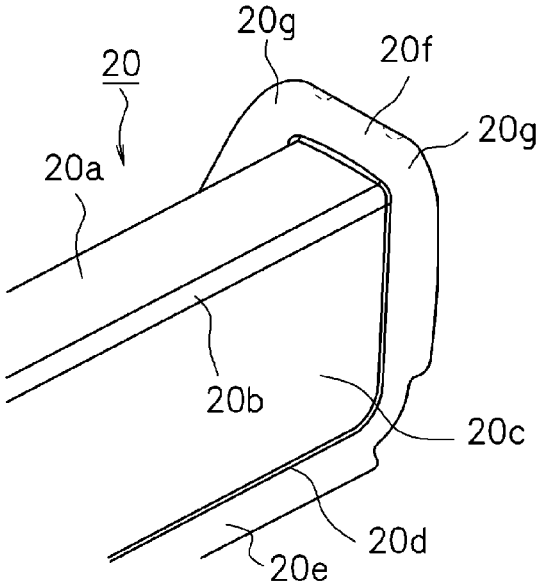
FIG. 5B is a view illustrating evaluation positions (a crack threat part) of the sheet thickness decrease being evaluation objects in the analysis example 1.

FIG. 5A is a characteristic diagram illustrating a numerical analysis result of a relationship between a pressing angle of the press-forming material 24 by the pads 23, 25 and a maximum value of a sheet thickness decrease at an end part of the ridge line part flange portion 20*g* of the outward flange 20*f* formed at the press-formed body 20. In FIG. 5B, evaluation positions of a sheet thickness decrease (ranges each surrounded by a dotted line, a crack threat part) being evaluation objects in the analysis example 1 are illustrated. The pressing angle means a center angle of a range of the ridge line part 20*b* bound by the pads 23, 25 while setting a position of a connecting part with the groove bottom part 20*a* as "0" (zero) degree from among a part to be formed into the ridge line part 20*b* at the press-forming material 24. Besides, as a maximum value of the sheet thickness decrease becomes large, stretch flange cracks occur.

In the conventional method, namely, in the bend-forming using the normal pad 23, the pad 23 binds a whole or only a part of the part to be formed into the groove bottom part 20*a* at the press-forming material 24 as illustrated in FIG. 4A to FIG. 4C. Namely, it is a shape in which a part to be formed into the ridge line part 20*b* is not bound, and the pressing angle is "0" (zero) degree.

In this case, as illustrated in FIG. 5A, a maximum value if the sheet thickness decrease at the end part of the ridge line part flange portion 20*g* is a value of approximately 36% which far exceeds 30%, and it can be seen that a possibility in which the stretch flange cracks occur is high.

On the other hand, in the invented method, namely, in the bend-forming using the ridge line pad 25, as illustrated in FIG. 3A to FIG. 3D, the ridge line pad 25 binds the part to be formed into the ridge line part 20*b* in addition to the part to be formed into the groove bottom part 20*a* in a vicinity of the outward flange 20*f* (a range within 10 mm from a root part of the outward flange 20*f* in a direction where the ridge line part 20*b* extends).

Then, analyses are performed under conditions in which a region where the ridge line pad 25 binds the press-forming material 24 is changed into one-third, two-thirds, and a whole of a cross-sectional peripheral length of the ridge line part 20*b* starting from a connecting part from among the part to be formed into the ridge line part 20*b*.

In this case, as illustrated in FIG. 5A, it can be seen that a maximum value of the sheet thickness decrease at the ridge line part flange portion 20*g* is suppressed as the region where the ridge line pad 25 binds the press-forming material 24 (pressing angle) becomes large. In particular, a suppression effect is remarkable when the binding region is one-third or more, and it is possible to avoid the stretch flange cracks.

Analysis Example 2

Figure 6A:
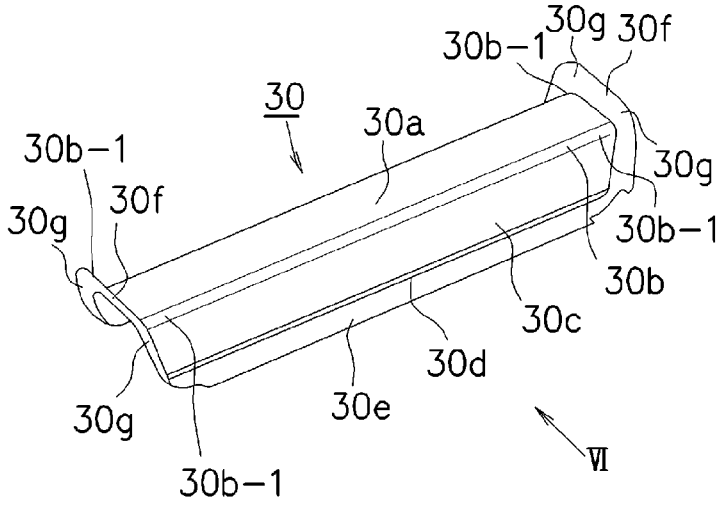
FIG. 6A is a perspective view of a press-formed body of an analysis example 2.
Figure 6B:
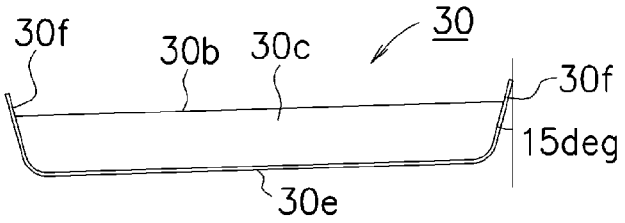
FIG. 6B is a VI arrow view in FIG. 6A.
Figure 6C:
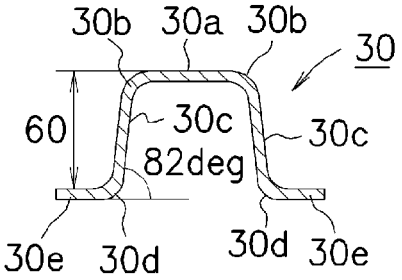
FIG. 6C is a transverse sectional view of the press-formed body of the analysis example 2.

FIG. 6A to FIG. 6C are explanatory views illustrating a shape of a press-formed body 30 of an analysis example 2. FIG. 6A is a perspective view of the press-formed body 30, FIG. 6B is a VI arrow view in FIG. 6A, and FIG. 6C is a transverse sectional view of the press-formed body 30 (an outward flange 30*f* is not illustrated).

The press-formed body 30 of the analysis example 2 is made of the high-strength steel sheet (590 MPa class DP steel), and a sheet thickness thereof is 1.4 mm.

The press-formed body 30 includes a groove bottom part 30*a*, ridge line parts 30*b*, 30*b* continuous to the groove bottom part 30*a*, side wall parts 30*c*, 30*c* continuous to the ridge line parts 30*b*, 30*b*, curved parts 30*d*, 30*d* continuous to the side wall parts 30*c*, 30*c*, and flanges 30*e*, 30*e* continuous to the curved parts 30*d*, 30*d*. A curvature radius at a sheet inner side of the ridge line parts 30*b*, 30*b* is 12 mm.

The outward flange 30*f* is formed at a whole periphery of both end parts in a longitudinal direction of the press-formed body 30, and a ridge line part flange portion 30*g* becomes a curved portion. A flange width of the outward flange 30*f* is 20 mm at a part formed along the groove bottom part 30*a*, and 25 mm at a part formed along the side wall parts 30*c*, 30*c*.

A cross sectional wall angle of the press-formed body 30 is 82 degrees, and a cross sectional height is 60 mm. In the analysis example 2, the press-formed body 30 is manufactured by the press-forming by bend-forming using a developed blank.

Figure 7A:
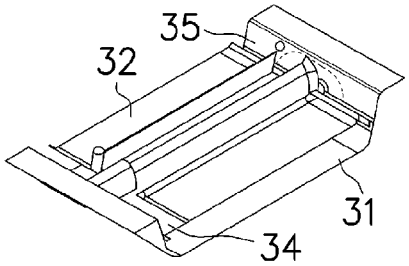
FIG. 7A is a perspective view illustrating a punch, a die, a ridge line pad, and a press-forming material at a forming time according to the invented method.
Figure 7B:
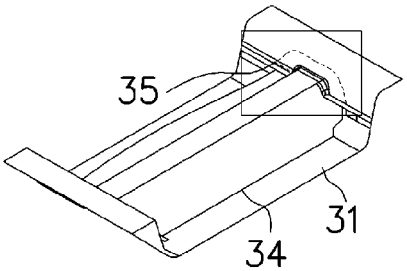
FIG. 7B is a perspective view illustrating the punch, the ridge line pad, and the press-forming material at the forming time according to the invented method.
Figure 7C:
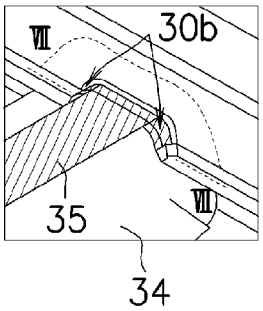
FIG. 7C is a perspective view enlargedly illustrating a square surrounded part in FIG. 7B.
Figure 7D:
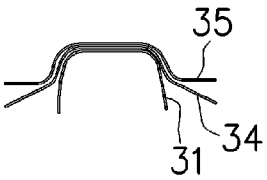
FIG. 7D is a VII-VII sectional view in FIG. 7C.

FIG. 7A is a perspective view illustrating a punch (lower forming-tool) 31, a die (upper forming-tool) 32, a ridge line pad 35, and a press-forming material 34 at a forming time according to the invented method. FIG. 7B is a perspective view illustrating the punch (lower forming-tool) 31, the ridge line pad 35, and the press-forming material 34 at the formed time according to the invented method. FIG. 7C is a perspective view enlargedly illustrating a square surrounded part in FIG. 7B. FIG. 7D is a VII-VII sectional view in FIG. 7C.

Figure 8A:
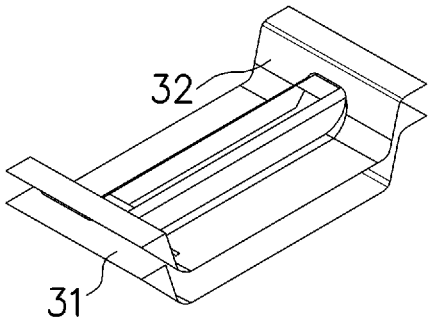
FIG. 8A is a perspective view illustrating a punch and a die at a forming time according to the conventional method.
Figure 8B:
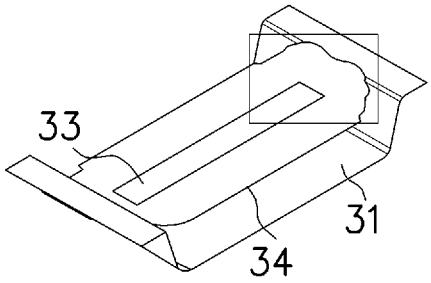
FIG. 8B is a perspective view illustrating the punch, a pad, and a press-forming material at the forming time according to the conventional method.
Figure 8C:
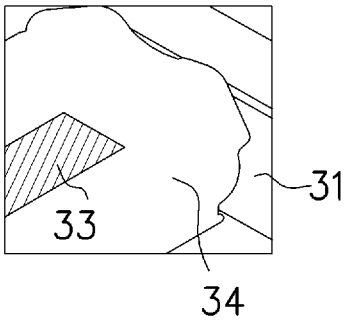
FIG. 8C is a perspective view enlargedly illustrating a square surrounded part in FIG. 8B.

On the other hand, FIG. 8A is a perspective view illustrating a punch (lower forming-tool) 31, a die (upper forming-tool) 32 at a forming time according to the conventional method. FIG. 8B is a perspective view illustrating the punch (lower forming-tool) 31, a pad 33, and a press-forming material 34 at the forming time according to the conventional method. FIG. 8C is a perspective view enlargedly illustrating a square surrounded part in FIG. 8B.

Figure 9A:
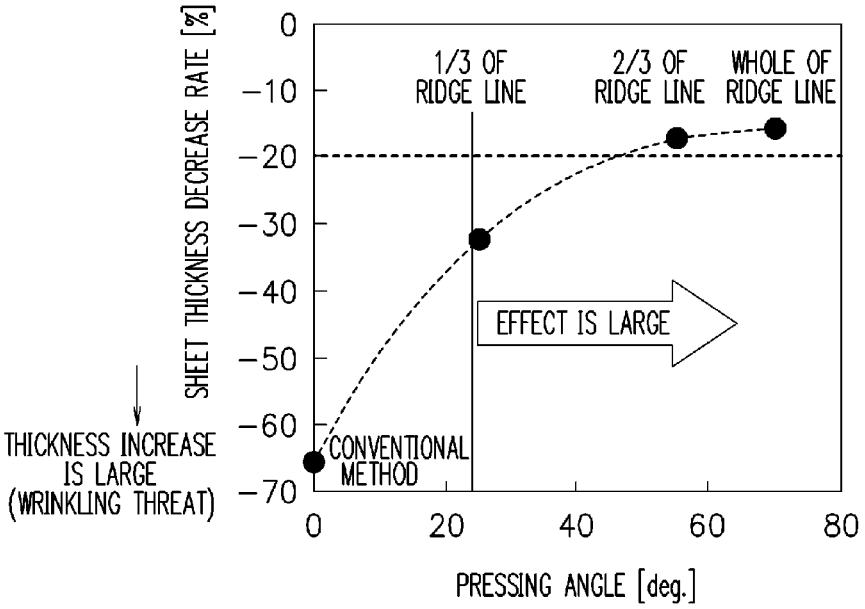
FIG. 9A is a characteristic diagram illustrating a numerical analysis result of a relationship between a pressing angle of the press-forming material by the pad and a minimum value of sheet thickness decrease in a vicinity of a root part of a ridge line part flange portion of an outward flange in the analysis example 2.
Figure 9B:
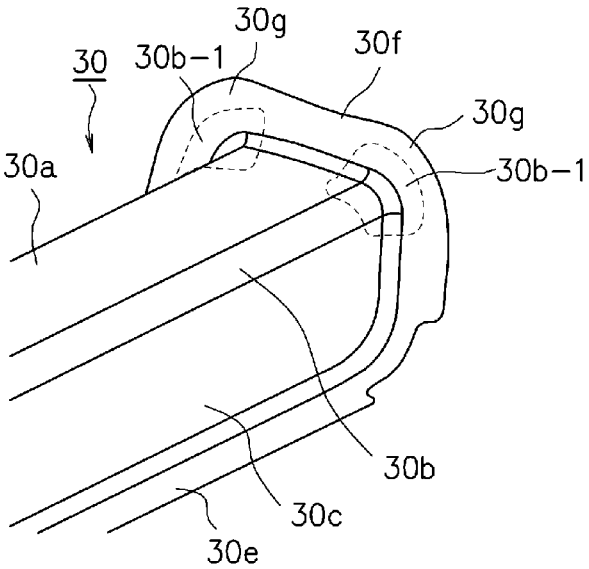
FIG. 9B is a view illustrating evaluation positions (a wrinkling threat part) of the sheet thickness decrease being evaluation objects in the analysis example 2.

FIG. 9A is a characteristic diagram illustrating a numerical analysis result of a relationship between a pressing angle of the press-forming material 34 by the pads 33, 35 and a minimum value of a sheet thickness decrease in a vicinity of a root part of the ridge line part flange portion 30*g* of the outward flange 30*f* formed at the press-formed body 30. In FIG. 9B, evaluation positions of a sheet thickness decrease (ranges each surrounded by a dotted line, a wrinkling threat part) being evaluation objects in the analysis example 2 are illustrated. The pressing angle means a center angle of a range of the ridge line part 30*b* bound by the pads 33, 35 while setting a connecting part with the groove bottom part 30*a* as "0" (zero) degree from among a part to be formed into the ridge line part 30*b* at the press-forming material 34. Besides, as a minimum value of the sheet thickness decrease becomes small, a possibility in which wrinkling occurs becomes high.

In the conventional method, namely, in the bend-forming using the normal pad 33, the pad 33 binds only a part to be formed into the groove bottom part 30*a* at the press-forming material 34 as illustrated in FIG. 8A to FIG. 8C. Namely, it is a shape in which a part to be formed into the ridge line part 30*b* is not bound, and the pressing angle is "0" (zero) degree.

In this case, as illustrated in FIG. 9A, a minimum value of the sheet thickness decrease at the root part of the ridge line part flange portion 30*g* is a value of approximately −65%, and it is obvious that the winkling occurs at a proximity part 30*b*-1 of the flange 30*f* at the ridge line part 30*b*.

On the other hand, in the invented method, namely, in the bend-forming using the ridge line pad 35, as illustrated in FIG. 7A to FIG. 7D, the ridge line pad 35 binds the part to be formed into the ridge line part 30*b* in addition to the part to be formed into the groove bottom part 30*a* in a vicinity of the outward flange 30*f* (a range within 10 mm from a root part of the outward flange 30*f* in a direction where the ridge line part 30*b* extends).

Then, analyses are performed under conditions in which a region where the ridge line pad 35 binds the press-forming material 34 is changed into one-third, two-thirds, a whole of a cross-sectional peripheral length of the ridge line part 30*b* starting from a connecting part from among the part to be formed into the ridge line part 30*b*.

In this case, as illustrated in FIG. 9A, it can be seen that thickening at the proximity part 30*b*-1 of the flange 30*f* at the ridge line part 30*b* is suppressed as the region where the ridge line pad 35 binds the press-forming material 34 (pressing angle) becomes large. In the analysis result, a thickening amount is large because it is originally a shape difficult to suppress the wrinkling. Therefore it is desired to suppress a thickening rate to be less than 20% by setting the region binding the ridge line part 30*b* to be two-thirds or more, but even when the region binding the ridge line part 30*b* is approximately one-third or more, the thickening of a part where the wrinkling occurrence is concerned is suppressed to be a half or less compared to the normal pad, and it can be seen that a thickening suppression effect by the ridge line pad 35 is very large.

Analysis Example 3

In each of the analysis examples 1, 2, a cold-rolled steel sheet is described, but the present invention is able to be applied for a hot-rolled steel sheet.

Figure 10A:
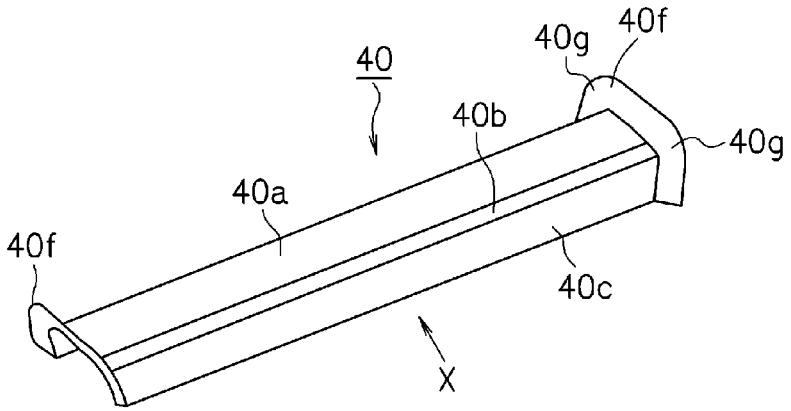
FIG. 10A is a perspective view of a press-formed body of an analysis example 3.
Figure 10B:
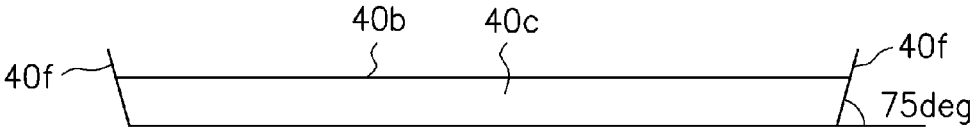
FIG. 10B is an X arrow view in FIG. 10A.
Figure 10C:
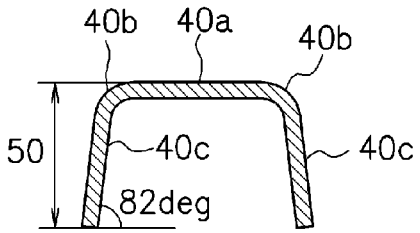
FIG. 10C is a transverse sectional view of the press-formed body of the analysis example 3.

FIG. 10A to FIG. 10C are explanatory views illustrating a shape of a press-formed body 40 of an analysis example 3. FIG. 10A is a perspective view of the press-formed body 40, FIG. 10B is a X arrow view in FIG. 10A, and FIG. 10C is a transverse sectional view of the press-formed body 40 (an outward flange 40*f* is not illustrated).

The press-formed body 40 of the analysis example 3 is made of the high-strength steel sheet (590 MPa class DP steel), and a sheet thickness thereof is 2.9 mm.

The press-formed body 40 includes a groove bottom part 40*a*, ridge line parts 40*b*, 40*b* continuous to the groove bottom part 40*a*, and side wall parts 40*c*, 40*c* continuous to the ridge line parts 40*b*, 40*b*.

The outward flange 40*f* is formed at a whole periphery of both end parts in a longitudinal direction of the press-formed body 40, and a ridge line part flange portion 40*g* becomes a curved portion.

A cross sectional wall angle of the press-formed body 40 is 82 degrees, and a cross sectional height is 50 mm. In the analysis example 3, the press-formed body 40 is manufactured by the press-forming by bend-forming using a developed blank.

Also in the analysis example 3, the conventional method using the pad in which a part to be formed into the groove bottom part 40*a* is bound, but parts to be formed into the ridge line parts 40*b*, 40*b* are not bound and the invented method using a ridge line pad in which not only the part to be formed into the groove bottom part 40*a* but also the parts to be formed into the ridge line parts 40*b*, 40*b* in the vicinity of the outward flange 40*f* are bound are compared.

Figure 11A:
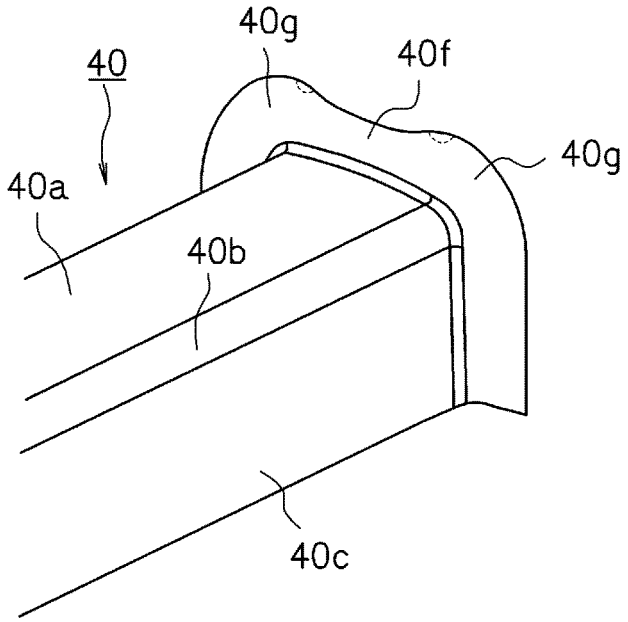
FIG. 11A is a view to explain a maximum value of a sheet thickness decrease at evaluation positions (a crack threat part) of a sheet thickness decrease according to the invented method.
Figure 11B:
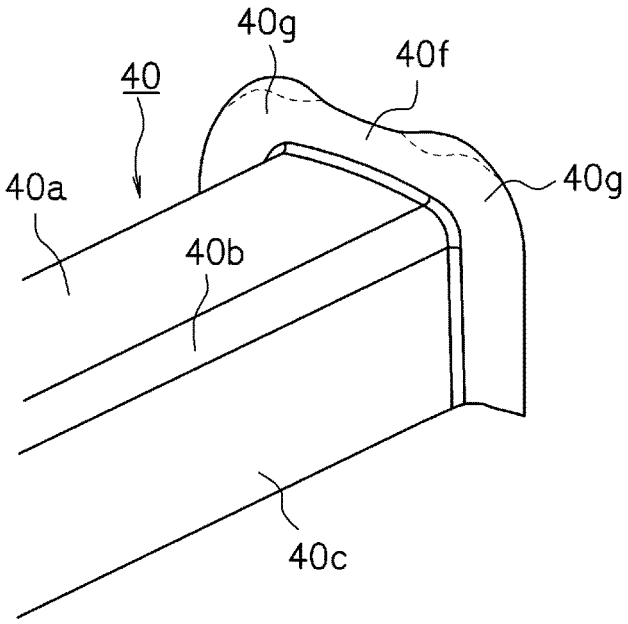
FIG. 11B is a view to explain a maximum value of a sheet thickness decrease at evaluation positions (a crack threat part) of a sheet thickness decrease according to the conventional method.

As illustrated in FIG. 11B, in the conventional method, a maximum value of the sheet thickness decrease at the evaluation positions of the sheet thickness decrease (ranges each surrounded by a dotted line, a crack threat part) is a value of approximately 20%. On the other hand, in the invented method, a maximum value of the sheet thickness decrease at the evaluation positions of the sheet thickness decrease (ranges each surrounded by a dotted line, a crack threat part) is suppressed to a value of approximately 14%.

As stated above, the present invention is described with various embodiments, but the present invention is not limited only to these embodiments, and modifications and so on within a range of the invention are possible.

For example, in each of the analysis examples, a case when the press-forming is the bend-forming is exemplified, but the present invention is not limited thereto, and the press-forming may be drawing.

Besides, a mode in which the lower forming-tool is made up by the punch and the upper forming-tool is made up by the die and the pad is exemplified, but the present invention is not limited to the mode. It goes without saying that a structure in which the upper and lower metal forming-tools are reversed, namely, the upper forming-tool is made up by the punch and the lower forming-tool is made up by the die and the pad is acceptable.

INDUSTRIAL APPLICABILITY

The present invention can be used for manufacturing a press-formed body made of a high-tensile strength steel sheet of 390 MPa or more having approximately a groove-shaped cross section including a groove bottom part, ridge line parts continuous to the groove bottom part, and side wall parts continuous to the ridge line parts, and in which an outward flange is formed at a range across the ridge part, at least a portion of each of the groove bottom part and the side wall part at both sides thereof, from among an end part in a longitudinal direction, without being limited to a floor cross member.

The invention claimed is:

1. A manufacturing method of a press-formed body comprising a high-tensile strength steel sheet of 390 MPa or more having a groove-shaped cross section, the groove-shaped cross section comprising a groove bottom part; at least two ridge line parts, each one of the at least two ridge line parts being adjacent to an end portion of the groove bottom part; and at least two side wall parts, each one of the at least two side wall parts being adjacent to one of the at least two ridge line parts; the manufacturing method comprising:

a first step of performing the press-forming while the pad presses (a) and (b) to the punch:

(a) a portion of areas of the press-forming material, which are to be formed into each of the at least two ridge line parts, (b) a different area of the press-forming material, which is to be formed into the grove bottom part, wherein (a) is in the vicinity of an outward flange, and has a predetermined length of a cross-sectional peripheral length starting at connecting parts which connect each of the at least two ridge line parts to the groove bottom part, wherein the outward flange is formed across the at least two ridge line parts, and is further formed in at least one end part in a longitudinal direction of the pressed-formed body, and wherein the press-forming is performed by a press-forming apparatus which includes a punch, a die, and a pad which presses the press-forming material to the punch; and a second step of performing press-forming of other areas of the press-forming material so as to form parts of the press-formed body which are not formed by the first step, wherein cutouts are not formed or provided at any portion of the at least two ridge line parts that are in the vicinity of the outward flange, or at any portion of the outward flange.

2. The manufacturing method of the press-formed body according to claim 1, wherein said predetermined length of a cross-sectional peripheral length is one-third or more of the cross-sectional peripheral length, and wherein the pad presses said one-third or more of the cross-sectional peripheral length.

3. The manufacturing method of the press-formed body according to claim 1, wherein the pad presses the portion of the press-forming material to be formed into the at least two ridge line parts within a predetermined range from a root part of the outward flange in a longitudinal direction.

4. The manufacturing method of the press-formed body according to claim 1, wherein the groove-shaped cross section further comprises curved parts continuous to the at least two side wall parts, and additional flanges continuous to the curved parts.

5. The manufacturing method of the press-formed body according to claim 1, wherein the press-forming is bend-forming.

6. The manufacturing method of the press-formed body according to claim 1, wherein the press-forming is drawing.

7. The manufacturing method of the press-formed body according to claim 1, wherein, in the first step, the groove bottom part, a portion of the at least two ridge line parts, a portion of the at least two side wall parts, and the outward flange are formed, and, in the second step, a remaining portion of the at least two ridge line parts and a remaining part of the at least two side wall parts, not formed in the first step, are formed.

8. The manufacturing method of the press-formed body according to claim 1, wherein:

the punch and the pad move relative to the die; and the punch and the pad move in the same direction, and towards the die.

9. A manufacturing apparatus for manufacturing a press-formed body, the press-formed body comprising a high-tensile strength steel sheet of 390 MPa or more having a groove-shaped cross section, the groove-shaped cross section comprising a groove bottom part; at least two ridge line parts, each one of the at least two ridge line parts being adjacent to an end portion of the groove bottom part; and at least two side wall parts, each one of the at least two side wall parts being adjacent to one of the at least two ridge line parts; the manufacturing apparatus comprising:

a punch;

a die; and a pad which presses a press-forming material to the punch, wherein the pad presses (a) and (b) to the punch, wherein (a) is a portion of areas of the press-forming material, which are to be formed into each of the at least two ridge line parts, and (b) is a different area of the press-forming material, which is to be formed into the groove bottom part;

wherein (a) is in the vicinity of an outward flange, and has a predetermined length of a cross-sectional peripheral length starting at connecting parts which connect each of the at least two ridge line parts to the groove bottom part, wherein the outward flange is formed across the at least two ridge line parts, and is further formed in at least one end part in a longitudinal direction of the pressed-formed body;

wherein the punch and the pad move relative to the die, wherein the punch and the pad move in the same parallel direction, and towards the die; and wherein cutouts are not formed or provided at any portion of the at least two ridge line parts that are in the vicinity of the outward flange, or at any portion of the outward flange.

10. The manufacturing apparatus of the press-formed body according to claim 9, wherein said predetermined length of a cross-sectional peripheral length is one-third or more of the cross-sectional peripheral length, and wherein the pad has a shape pressing said one-third or more of the cross-sectional peripheral length.

11. The manufacturing apparatus of the press-formed body according to claim 9, wherein the pad presses the portion of the press-forming material to be formed into the at least two ridge line parts within a predetermined range from a root part of the outward flange in a longitudinal direction.

12. The manufacturing apparatus of the press-formed body according to claim 9, wherein the groove-shaped cross section further comprises curved parts continuous to the at least two side wall parts, and additional flanges continuous to the curved parts.

13. The manufacturing apparatus of the press-formed body according to claim 9, wherein the press-forming is bend-forming.

14. The manufacturing apparatus of the press-formed body according to claim 9, wherein the press-forming is drawing.

* * * * *